US005930955A

United States Patent [19]

Biebuyck

[11] Patent Number: 5,930,955

[45] Date of Patent: Aug. 3, 1999

[54] DOOR ASSEMBLY

[75] Inventor: Lawrence F. Biebuyck, Garland, Tex.

[73] Assignee: Butler Manufacturing Company, Kansas City, Mo.

[21] Appl. No.: 08/925,549

[22] Filed: Sep. 8, 1997

[51] Int. Cl.[6] ..... E06B 7/16

[52] U.S. Cl. ..... 49/368; 49/366

[58] Field of Search ..... 49/366, 367, 368, 49/369, 370, 501

[56] References Cited

U.S. PATENT DOCUMENTS

| | | | |
|---|---|---|---|
| 3,827,183 | 8/1974 | Zimmerman et al. | 49/383 |
| 4,167,088 | 9/1979 | Governale | 52/207 |
| 4,214,405 | 7/1980 | Chupik | 49/382 |
| 4,370,827 | 2/1983 | Furuminato | 49/368 |
| 4,488,378 | 12/1984 | Symon | 49/141 |
| 4,573,287 | 3/1986 | Hagemeyer et al. | 49/381 |
| 5,749,175 | 5/1998 | Koike et al. | 49/366 |

OTHER PUBLICATIONS

"Series 5000 Sliding Glass Door by Howmet", brochure, 2 pages (no date).

*Primary Examiner*—Daniel P. Stodola
*Assistant Examiner*—Curtis A. Cohen
*Attorney, Agent, or Firm*—Jenkenkens & Gilchrist

[57] ABSTRACT

An apparatus for increasing the ability of a "double-door" door assembly to withstand stresses caused by high winds and flying debris associated therewith. The door assembly includes first and second doors. The first door has a first pivot stile for pivotally coupling with the first door jamb, and a first meeting stile. The second door has a second pivot stile for pivotally coupling with the second door jamb, and a second meeting stile. The first meeting stile has a greater depth, measured in a plane normal to the plane of the first door, than the remainder of the first door. Similarly, the second meeting stile has a greater depth, measured in a plane normal to the plane of the second door, than the remainder of the second door.

7 Claims, 4 Drawing Sheets

DOOR ASSEMBLY

FIELD OF THE INVENTION

The present invention pertains to door assemblies and, more particularly, but not by way of limitation, to improved apparatus and methods for increasing the ability of a "double-door", aluminum door assembly to withstand stresses caused by high winds and flying debris.

HISTORY OF THE RELATED ART

The prior art is replete with various external door assemblies having a variety of designs, constructed from a variety of materials, and for use in either commercial or residential applications. One conventional door assembly, which is typically used for commercial applications, is an external aluminum door assembly. Such external aluminum door assemblies typically comprise a single door having an aluminum body surrounding a central glass panel, or two mating doors, each having an aluminum body surrounding a central glass panel, that open at the middle. It is highly desirable for such aluminum door assemblies to provide a weather seal when closed; to have sufficient structural integrity to withstand normal opening and closing; to be capable of being used safely; and to present a pleasing aesthetic appearance.

One conventional aluminum door assembly is shown in FIGS. 1 and 2. Referring first to FIG. 1, aluminum door assembly 10 has two doors 12 and 14. Door 12 has a parallel pivot stile 16*a* and a meeting stile 18*a* fixedly coupled to a parallel top rail 20*a* and a bottom rail 22*a*. Pivot stile 16*a*, meeting stile 18*a*, top rail 20*a*, and bottom rail 22*a* support a panel member 24*a*. Panel member 24*a* is typically constructed from building glass, polycarbonate, or other conventional glazing material.

Similarly, door 14 has a parallel pivot stile 16*b* and a meeting stile 18*b* fixedly coupled to a parallel top rail 20*b* and a bottom rail 22*b*. Pivot stile 16*b*, meeting stile 18*b*, top rail 20*b*, and bottom rail 22*b* support a panel member 24*b*. Panel member 24*b* is typically constructed from building glass, polycarbonate, or other conventional glazing material.

Doors 12 and 14 are pivotally mounted in a frame 26. Frame 26 typically comprises parallel door jambs 28*a* and 28*b* fixedly coupled to a parallel transom 30 and a threshold 32. Pivot stiles 16*a* and 16*b* are pivotally mounted to jambs 28*a* and 28*b*, respectively, by conventional means, such as hinges. Such conventional hinges are preferably mounted at points 34 as shown in FIG. 1 so as to insure the structural integrity of the coupling between pivot stile 16*a* and jamb 28*a* and pivot stile 16*b* and jamb 28*b*. Although not shown in FIG. 1, doors 12 and 14 may each comprise a handle to facilitate the opening and closing of the door. Such handles may be located on meeting stiles 18*a* and 18*b*, or such handles may span across panel member 24*a* between pivot stile 16*a* and meeting stile 18*a* and across panel member 24*b* between pivot stile 16*b* and meeting stile 18*b*. In addition, door 12 may have locking pins at points 150*a* and 152*a* on meeting stile 18*a* that mate with corresponding holes on transom 30 and threshold 32, respectively, and door 14 may have locking pins at points 150*b* and 152*b* on meeting stile 18*b* that mate with corresponding holes on transom 30 and threshold 32, respectively.

Referring now to FIG. 2, a cross-sectional view of meeting stiles 18*a* and 18*b* along line 2—2 of FIG. 1 is shown. Meeting stile 18*a* comprises substantially parallel webs 36 and 38 fixedly coupled to parallel webs 40 and 42. Web 36 has tongues 44*a*, 46*a*, and 48*a* on its exterior surface, and web 38 has a generally convex geometry for interfacing with meeting stile 18*b*. Meeting stile 18*a* further comprises a glazing stop 50*a*. Glazing stop 50*a* has resilient legs 52, 54, 56, and 58 that engage tongues 44*a*, 46*a*, and 48*a*, respectively. Resilient legs 52, 54, 56, and 58 may be disengaged from tongues 44*a*, 46*a*, and 48*a* in order to replace panel member 24*a*. Glazing stop 50*a* also includes grooves 60 and 62. Panel member 24*a* is removably and frictionally supported by glazing stop 50*a* via resilient gaskets 64*a* and 66*a*. Resilient gaskets 64*a* and 66*a* each have tongues that engage grooves 60 and 62 of glazing stop 50*a*, respectively. Although not shown in FIGS. 1 and 2, panel member 24*a* is preferably supported within pivot stile 16*a*, top rail 20*a*, and bottom rail 22*a* using similar structure to glazing stop 50*a* and resilient gaskets 64*a* and 66*a*. As shown in FIG. 2, the center line of panel member 24*a* is preferably located a distance "a" from a rear surface 90*a* of door 12.

Meeting stile 18*b* comprises substantially parallel webs 68 and 70 fixedly coupled to parallel webs 72 and 74. Web 70 has tongues 44*b*, 46*b*, and 48*b* on its exterior surface, and web 68 has a region 76 that protrudes toward stile 18*a*. Meeting stile 18*b* also comprises a glazing stop 50*b*. Glazing stop 50*b* preferably has a substantially identical structure to glazing stop 50*a* of meeting stile 18*a*. Glazing stop 50*b* thus cooperates with resilient gaskets 64*b* and 66*b* to removably and frictionally support panel member 24*b*. Although not shown in FIGS. 1 and 2, panel member 24*b* is similarly supported within pivot stile 16*b*, top rail 20*b*, and bottom rail 22*b* using similar structure to glazing stop 50*b* and resilient gaskets 64*b* and 66*b*. As shown in FIG. 2, the centerline of panel member 24*b* is preferably located a distance "a" from a rear surface 90*b* of door 14.

Meeting stile 18*b* further comprises a sealing member 78 that is movably coupled to region 76 of web 68 via a screw 80 and a hole (not shown) in region 76 for receiving screw 80. A leaf spring 82 biases sealing member 78 away from region 76. Sealing member 78 has a generally convex surface for interfacing with web 38 of meeting stile 18*a*, and sealing member 78 also has grooves 84 for receiving weather stripping 86. The movement of sealing member 78 along the x-axis toward web 68 is limited by the exterior surface of grooves 84 abutting web 68. As may be appreciated by one skilled in the art, when doors 12 and 14 are closed, sealing member 78 moves along the x-axis so as to create a weather seal between weather stripping 86 and web 38 of meeting stile 18*a*.

Referring now to FIGS. 1, 2, and 4, rear surface 90*a* of door 12 is preferably planar and is preferably composed of the rear surfaces of pivot stile 16*a*, top rail 20*a*, bottom rail 22*a*, and meeting stile 18*a*. Similarly, rear surface 90*b* of door 14 is preferably planar and is preferably composed of the rear surfaces of pivot stile 16*b*, top rail 20*b*, bottom rail 22*b*, and meeting stile 18*b*. Transom 30 preferably has a weather stripping 79 for interfacing with the top of pivot stile 16*a*, top rail 20*a*, meeting stile 18*a*, meeting stile 18*b*, top rail 20*b*, and pivot stile 16*b* at rear surfaces 90*a* and 90*b*.

In addition, as shown FIG. 2, when door assembly 10 is closed, rear surfaces 90*a* and 90*b* are preferably coplanar with a door jamb line 92. Door jamb line 92 is coplanar with and intersects a line in the y-z plane of jambs 28*a* and 28*b* along which pivot stiles 16*a* and 16*b* are hinged.

Conventional aluminum door assembly 10 is available in a variety of industry standard depths, measured along the z-axis, such as 1.75 inches and 2 inches. In environments subject to high winds, such as those present in a hurricane or similar storm, it is conventional to utilize door assemblies 10 having a 2 inch or greater depth, as the strength and stiffness of door assembly 10 generally increases with increasing depth. However, increasing the depth of door assembly 10 results in a heavier door, substantially increases material and manufacturing costs, and, in some cases, requires a custom frame for supporting the door. Therefore, a need exists in the industry for improved apparatus and methods of increasing the strength and stiffness of aluminum door assembly 10 that are not subject to the above-described limitations.

SUMMARY OF THE INVENTION

The present invention relates to improved apparatus and methods for increasing the ability of a "double-door" door assembly to withstand stresses caused by high winds and flying debris. More particularly, one aspect of the present invention comprises a door assembly having a first door and a second door. The first door has a pivot stile for pivotally coupling with a first door jam, and a first meeting stile. The second door has a second pivot stile for pivotally coupling with a second door jam, and second meeting stile. The first meeting stile has a greater depth, measured in a plane normal to a plane of the first door, than the remainder of the first door. Similarly, the second meeting stile has a greater depth, measured in a plane normal to a plane of the second door, than the remainder of the second door.

In another aspect, the present invention comprises a method of increasing the strength and stiffness of a door assembly. The door assembly includes a first door having a first pivot stile for pivotally coupling with a first door jamb, and a first meeting stile. The door assembly further includes a second door having a second pivot stile for pivotally coupling with a second door jamb, and a second meeting stile. A depth of the first meeting stile, measured in a plane normal to a plane of the first door, is increased relative to a remainder of the first door. Similarly, a depth of the second meeting stile, measured in a plane normal to the plane of the second door, is increased relative to a remainder of the second door.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENT

The preferred embodiment of the present invention and its advantages are best understood by referring to FIGS. 1–4 of the drawings, like numerals being used for like and corresponding parts of the various drawings.

Figure 2:
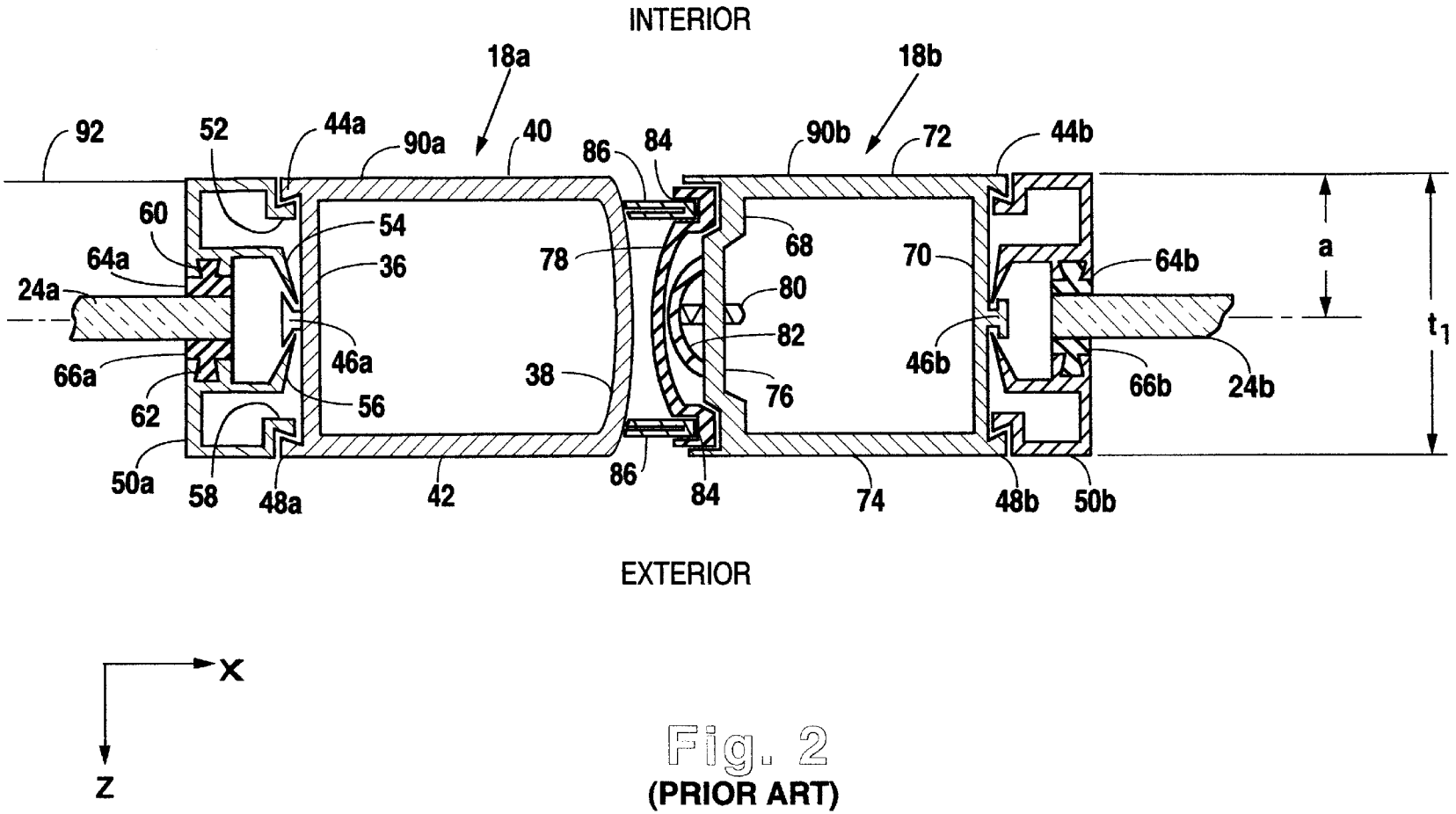
Fig. 2 (PRIOR ART)
FIG. 2 is a cross-sectional view of the conventional door assembly of FIG. 1 along line 2—2.
Figure 3:
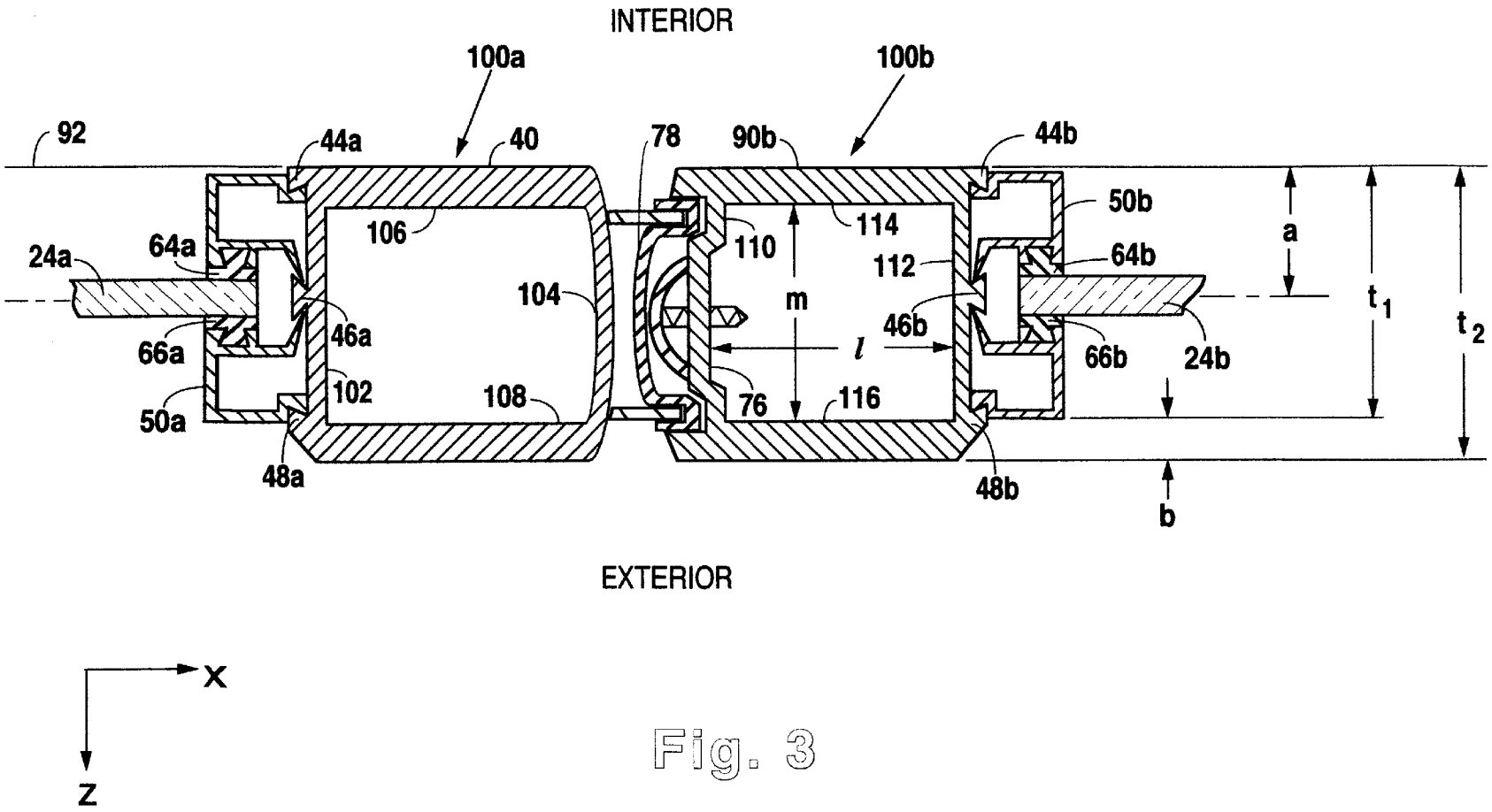
FIG. 3 is a cross-sectional view of a door assembly similar to the conventional door assembly of FIG. 1 along line 2—2 but incorporating modified meeting stiles according to a preferred embodiment of the present invention.
Figure 4:
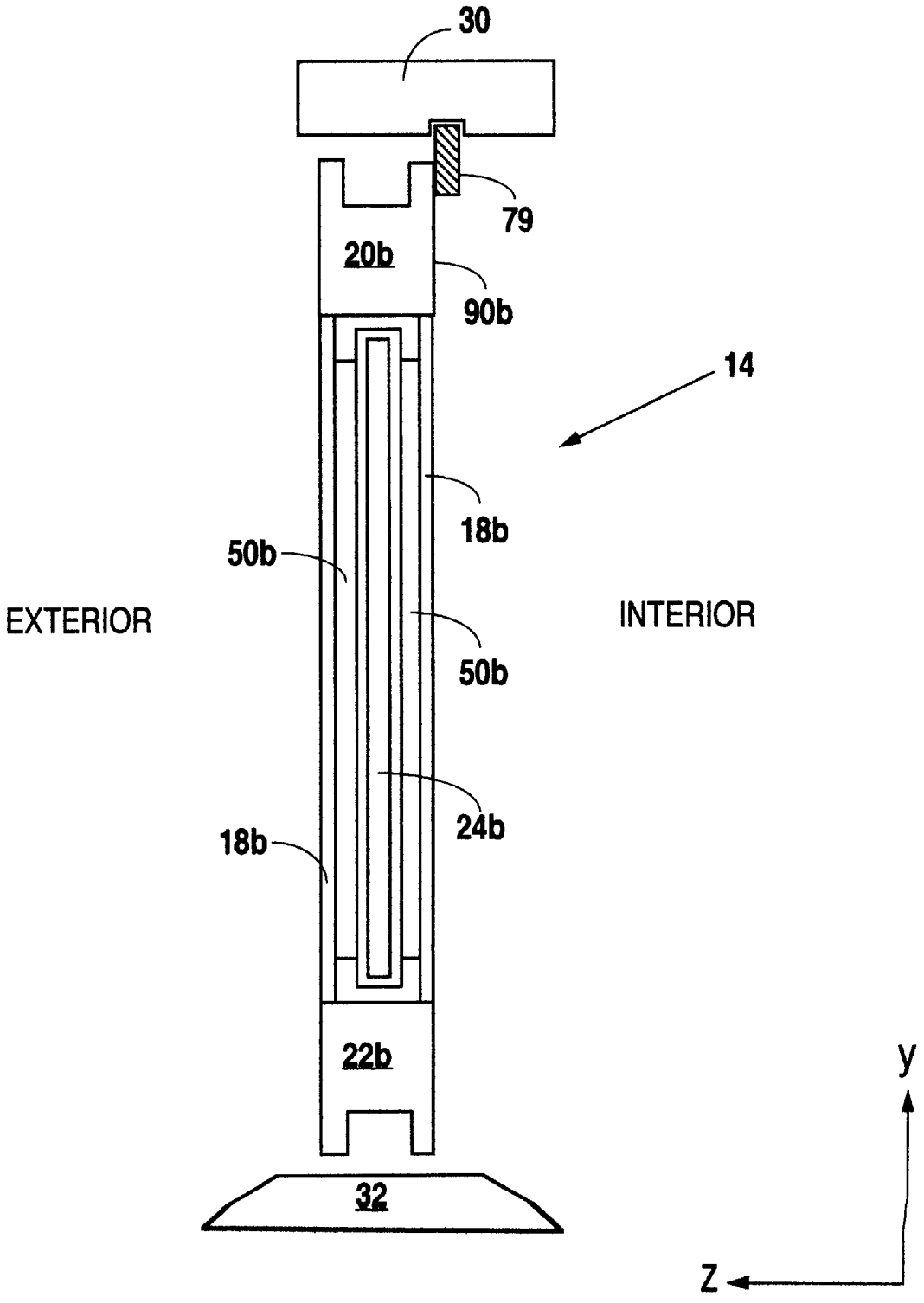
Fig. 4 (PRIOR ART)
FIG. 4 is a cross-sectional view of the conventional door assembly of FIG. 1 along line 4—4 illustrating a weather seal created along a rear surface of the doors.

Referring first to FIG. 3, modified meeting stiles 100*a* and 100*b* according to a preferred embodiment of the present invention are illustrated. Meeting stiles 100*a* and 100*b* replace meeting stiles 18*a* and 18*b*, respectively, in conventional aluminum door assembly 10 of FIGS. 1 and 2. Meeting stile 100*a* comprises substantially parallel webs 102 and 104 fixedly coupled to parallel webs 106 and 108. Web 102 has tongues 44*a*, 46*a*, and 48*a* on its exterior surface for engaging glazing stop 50*a*, and web 104 has a generally convex geometry for interfacing with meeting stile 100*b*. Meeting stile 100*b* comprises substantially parallel webs 110 and 112 fixedly coupled to parallel webs 114 and 116. Web 112 has tongues 44*b*, 46*b*, and 48*b* on its exterior surface for engaging glazing stop 50*b*, and web 110 has a region 76 for engaging sealing member 78. As may be appreciated from a comparison of FIGS. 2 and 3, glazing stop 50*a*, resilient gasket 64*a*, and resilient gasket 66*a* are preferably identical in meeting stile 100*a* and in conventional meeting stile 18*a*. Similarly, glazing stop 50*b*, resilient gasket 64*b*, resilient gasket 66*b*, and sealing member 78 are preferably identical in meeting stile 100*b* and in conventional meeting stile 18*b*.

Meeting stiles 100*a* and 100*b* differ from conventional meeting stiles 18*a* and 18*b* in several, critical structural aspects that provide significant advantages. As may be appreciated by one skilled in the art from a comparison of FIGS. 2 and 3, the strength and stiffness of meeting stiles 100*a* and 100*b* has been increased from that of conventional meeting stiles 18*a* and 18*b*, respectively. As shown in FIG. 3, this increase in strength and stiffness is preferably obtained by increasing the thickness of webs 106 and 108 of meeting stile 100*a* and of webs 114 and 116 of meeting stile 100*b* along the z axis in a direction toward the exterior of doors 12 and 14. This increase in the thickness of the webs results in an increase in the overall depth "$t_2$" of meeting stiles 100*a* and 100*b*, so that "$t_2$" is greater than the overall depth "$t_1$" of conventional meeting stiles 18*a* and 18*b*. However, the only change in the exterior dimensions of meeting stiles 100*a* and 100*b*, relative to conventional meeting stiles 18*a* and 18*b*, is a protrusion "b" along the front, or exterior, surface of the stiles. Therefore, although the thickness of the webs has been increased, rear surfaces 90*a* and 90*b* of doors 12 and 14 at meeting stiles 100*a* and 100*b* remain planar with the remainder of rear surfaces 90*a* and 90*b*, allowing the weather seal created by weather stripping 79 to remain intact. In addition, the center line of panel members 24*a* and 24*b* remains supported a distance "a" from rear surfaces 90*a* and 90*b*, respectively, so that the position of panel members 24*a* and 24*b* along the z axis in doors 12 and 14 does not change. Furthermore, pivot stiles 16*a* and 16*b*, top rails 20*a* and 20*b*, and bottom rails 22*a* and 22*b* all preferably still have a depth of "$t_1$" along the z axis. In short, meeting stiles 100*a* and 100*b* may be incorporated into conventional door assembly 10 without any modification to pivot stiles 16*a* and 16*b*, top rails 20*a* and 20*b*, bottom rails 22*a* and 22*b*, glazing stops 50*a* and 50*b*, panel members 24*a* and 24*b*, or frame 26.

As will be understood by one skilled in the art, the strength and stiffness of meeting stiles 100*a* and 100*b* may be increased in several alternative, or additional, ways other than increasing the thickness of webs 106 and 108 of meeting stile 100*a* and of webs 114 and 116 of meeting stile 100*b* along the z axis in a direction toward the exterior of doors 12 and 14, as shown in FIG. 3. For example, the thickness of webs 106 and 114 may be increased along the z axis in a direction toward the exterior of doors 12 and 14 by a greater amount than shown in FIG. 3. As another example, the thickness of webs 108 and 116 may be increased along the z axis in a direction toward the exterior of doors 12 and 14, or in a direction toward the interior of doors 12 and 14, by a greater amount than shown in FIG. 3. As a further example, the thickness of web 102 may be increased along the x axis in a direction toward meeting stile 100*b*, and the thickness of web 110 may be increased along the x axis in a direction toward the interior of meeting stile 100*b*. As a final example, the thickness of web 104 may be increased along the x-axis in a direction toward the interior of meeting stile 100*a*, and the thickness of web 112 may be increased along the x axis in a direction toward meeting stile 100*a*.

These alternative, or additional, increases in thickness cause no change in the exterior dimensions of meeting stiles 100*a* and 100*b*, relative to conventional meeting stiles 18*a* and 18*b*, with the possible exception of a lengthening of protrusion "b" along the z-axis in a direction toward the exterior of doors 12 and 14. Of course, these increases in thickness will also increase the weight of doors 12 and 14 at their meeting stiles, and this factor should be taken into account in determining the optimum amount of any such increases in thickness. In addition, as shown in FIG. 3, minimum interior dimensions "l" and "m" may be required in meeting stile 100*b* due to space constraints imposed by operating hardware such as door locks and lock systems. Such space constraints may impose a practical limit on the amount that the thicknesses of webs 110 and 112 may be increased along the x axis in a direction toward the interior of meeting stile 100*b*, and on the amount that the thickness of webs 114 and 116 may be increased along the z axis in a direction toward the interior of meeting stile 100*b*.

The following example illustrates the preferred dimensions for meeting stiles 100*a* and 100*b* incorporated into a conventional aluminum door assembly 10 having an industry standard depth of 1.75 inches. In such a door assembly 10, pivot rails 16*a* and 16*b*, top rails 20*a* and 20*b*, and bottom rails 22*a* and 22*b* all have about a 1.75 inch depth "$t_1$" along the z axis. Meeting stiles 100*a* and 100*b* have about a 2.0 inch depth "$t_2$" along the z axis. Panel members 24*a* and 24*b* have about a 0.25 inch thickness along the z axis, and panel members 24*a* and 24*b* are supported within pivot rails 16*a* and 16*b*, top rails 20*a* and 20*b*, bottom rails 22*a* and 22*b*, and meeting stiles 100*a* and 100*b*, respectively, so that a centerline of panel members 24*a* and 24*b* is located about 0.875 inches from rear surfaces 90*a* and 90*b*. Webs 106, 108, 114, and 116 have a general thickness of about 0.25 inches along the z axis. Webs 102, 104, 110, and 112 have a general thickness of about 0.125 inches along the x axis, and protrusion "b" is about 0.25 inches.

Figure 1:
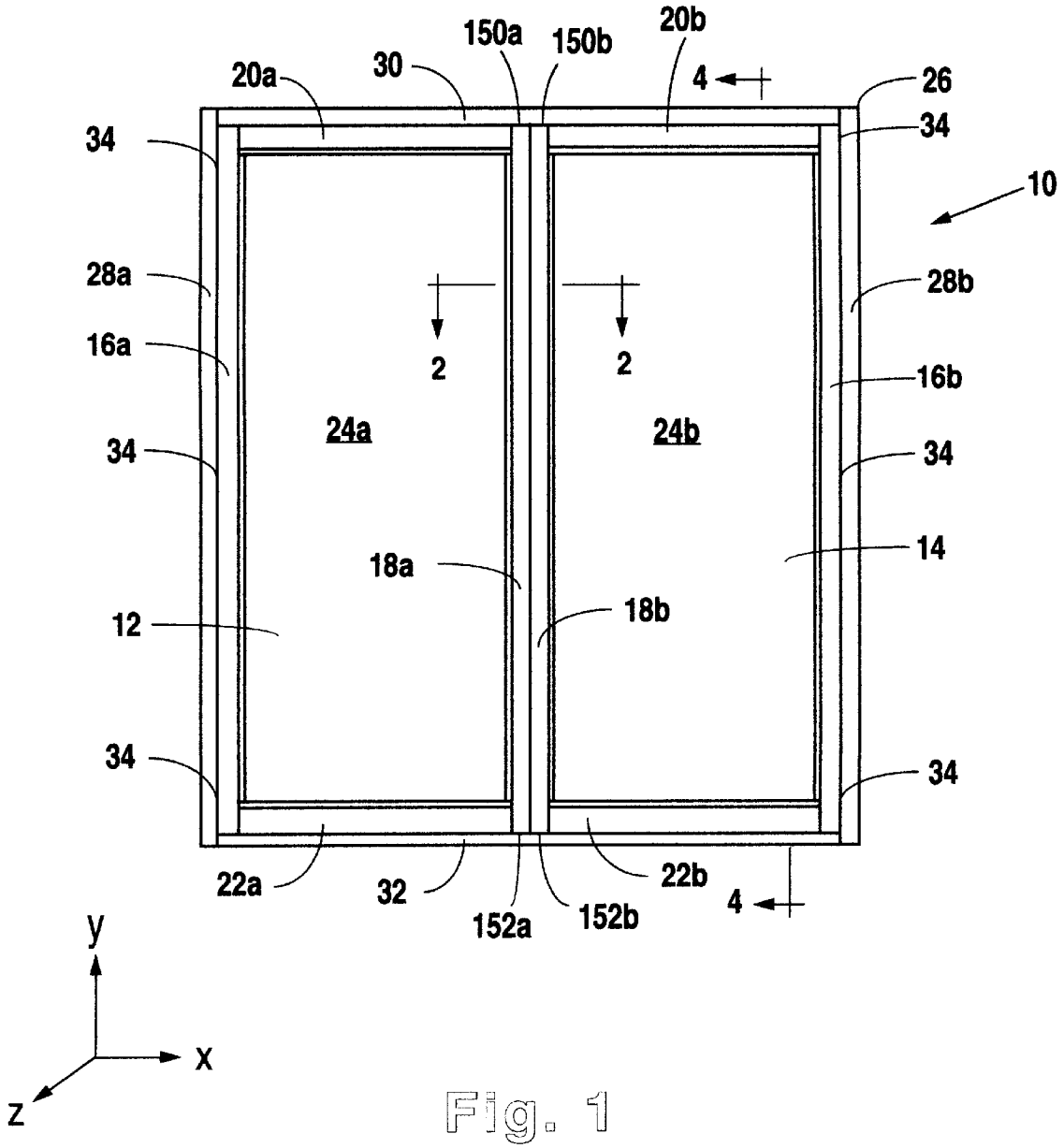
Fig. 1 (PRIOR ART)
FIG. 1 is a schematic, front elevational view of a conventional, "double-door" door assembly.

Having described the structure of door assembly 10, the operation of the door assembly in heavy winds and flying debris associated therewith will now be described in more detail. Referring to FIGS. 1–2, when doors 12 and 14 of conventional door assembly 10 are closed, and a strong wind is blowing against doors 12 and 14 in a direction generally along the z axis, the portions of door assembly 10 most likely to deflect, and possibly cause failure of door assembly 10, are meeting stiles 18*a* and 18*b*. This failure mode is most prevalent because pivot stiles 16*a* and 16*b* are hinged to jambs 28*a* and 28*b* at points 34, and top rails 20*a* and 20*b* and bottom rails 22*a* and 22*b* have a relatively short length as compared to the length of meeting stiles 18*a* and 18*b*.

Referring to FIG. 3, by replacing conventional meeting stiles 18*a* and 18*b* with the stronger, more stiff meeting stiles 100*a* and 100*b* of the present invention, the overall strength and stiffness of door assembly 10 is significantly increased, and the modified door assembly 10 will be able to withstand higher winds. In addition, as the depth of the pivot stiles, the top rails, and the bottom rails of modified door assembly 10 remain the same as in conventional door assembly 10, the weight of door assembly 10 and the material and manufacturing costs of door assembly 10 are not substantially increased. Furthermore, these advantages may be obtained with only minimal structural modifications to an industry standard door assembly and an industry standard frame. Significantly, meeting stiles 100*a* and 100*b* can be incorporated into a conventional door assembly 10 without any modifications to pivot stiles 16*a* and 16*b*, top rails 20*a* and 20*b*, bottom rails 22*a* and 22*b*, glazing stops 50*a* and 50*b*, panel members 24*a* and 24*b*, or frame 26.

The present invention is illustrated herein by example, and various modifications may be made by a person of ordinary skill in the art. For example, numerous geometries and/or relative dimensions could be altered to accommodate specific applications of the modified meeting stiles of the present invention in a variety of door assemblies. As another example, although the present invention has been described in connection with aluminum door assemblies, it is equally applicable to fire rated door assemblies and door assemblies made from other conventional building materials, such as metals other than aluminum, wood, plastics, or composite materials.

It is thus believed that the operation and construction of the present invention will be apparent from the foregoing description. While the method and apparatus shown or described have been characterized as being preferred it will be obvious that various changes and modifications may be made therein without departing from the spirit and scope of the invention as defined in the following claims.

What is claimed is:

1. A door assembly, comprising:

a first door having:

a first pivot stile for pivotally coupling with a first door jam, said first pivot stile having a rear surface and a front surface spaced from said rear surface at a distance defining the thickness of said first door; and a first meeting stile having a rear surface and a front surface spaced from said rear surface at a distance greater than the defined thickness of said first door;

a second door having:

a second pivot stile for pivotally coupling with a second door jam, said second pivot stile having a rear surface and a front surface spaced from said rear surface at a distance defining the thickness of said second door; and second meeting stile having a rear surface and a front surface spaced from said rear surface at a distance greater than the defined thickness;

wherein the rear surfaces of said first pivot stile and said first meeting stile are substantially planar surfaces respectively disposed in a common plane defining a rear plane of said first door, the front surface of said first pivot stile is a substantially planar surface defining a front plane of said first door, and the front surface of said first meeting stile is a substantially planar surface disposed outwardly from the front plane of the first door and in parallel planar relationship therewith, and the rear surface of the second pivot style and the second meeting stile are substantially planar surfaces respectively disposed in a common plane defining a rear plane of said second door, the front surface of said second pivot stile is a substantially planar surface defining a front plane of said second door, and the front surface of said first meeting stile is a substantially planar surface disposed outwardly from the front plane of the second door and in parallel planar relationship therewith.

2. The door assembly of claim 1 wherein:

said first door comprises:

a first top rail coupled between said first pivot stile and said first meeting stile and having a rear surface coplanarly disposed with the defined rear plane of said first door and a front surface coplanarly disposed with the defined front plane of said first door;

a first bottom rail coupled between said first pivot stile and said first meeting stile and having a rear surface coplanarly disposed with the defined front plane of said first door; and a first panel member interposed between and in parallel planar relationship with the defined rear and front planes of the first door and supported by said first pivot stile, said first meeting stile, said first top rail, and said first bottom rail;

and said second door further comprises:

a second top rail coupled between said second pivot stile and said second meeting stile and having a rear surface coplanarly disposed with the defined rear plane of said second door and a front surface coplanarly disposed with the defined front plane of said second door;

a second bottom rail coupled between said second pivot stile and said second meeting stile and having a rear surface coplanarly disposed with the defined rear plane of said second door and a front surface coplanarly disposed with the defined front plane of said second door; and a second panel member interposed between and in parallel planar relationship with the defined rear and front planes of the second door and supported by said second pivot stile, said second meeting stile, said second top rail, and said second bottom rail.

3. The door assembly of claim 2 wherein:

said rear plane of said first door is defined by the respective rear surfaces of said first pivot stile, said first top rail, said first bottom rial, and said first meeting stile; and said rear plane of said second door is defined by the respective rear surface of said second pivot stile, said second top rail, said second bottom rail, and said second meeting stile.

4. The door assembly of claim 3 wherein said door assembly is closed, said defined rear planes of said first and second doors are coplanarly disposed.

5. The door assembly of claim 4 wherein a top of said rear surface of said first and second pivot stiles, a top of said rear surface of said first and second top rails, and a top of said rear surface of said first and second meeting stiles are adapted to interface with a weather stripping.

6. The door assembly of claim 5 wherein said door assembly includes a transom and said weather stripping is disposed along said transom.

7. The door assembly of claim 2 wherein said first and second panel members comprise glass panels, and the respective pivot stiles, meeting stiles, top rails and bottom rails of said first and second doors are aluminum.

* * * * *